US008826961B2

(12) United States Patent
Castagnetta et al.

(10) Patent No.: US 8,826,961 B2
(45) Date of Patent: Sep. 9, 2014

(54) FINISHER SYSTEM

(75) Inventors: David J. Castagnetta, Maple Grove, MN (US); Matthew W. Jungklaus, Lawrenceville, GA (US); Charles C. Somers, III, Snellville, GA (US)

(73) Assignees: Axia Acquisition Corporation, Duluth, GA (US); Graco Inc., Minneapolis, MN (US)

( * ) Notice: Subject to any disclaimer, the term of this patent is extended or adjusted under 35 U.S.C. 154(b) by 152 days.

(21) Appl. No.: 13/151,167

(22) Filed: Jun. 1, 2011

(65) Prior Publication Data

US 2011/0297327 A1 Dec. 8, 2011

Related U.S. Application Data

(60) Provisional application No. 61/350,372, filed on Jun. 1, 2010.

(51) Int. Cl.

| | |
|---|---|
| ***B05C 11/10*** | (2006.01) |
| ***B25G 1/10*** | (2006.01) |
| ***E04F 21/165*** | (2006.01) |
| ***B25G 3/38*** | (2006.01) |

(52) U.S. Cl.

CPC ..... *E04F 21/165* (2013.01); *B25G 3/38* (2013.01)

USPC ..... 156/574; 156/578; 156/579; 401/5; 401/138; 401/139

(58) Field of Classification Search

USPC ..... 156/574, 577, 578, 579; 401/5, 138, 401/139, 140

See application file for complete search history.

(56) References Cited

U.S. PATENT DOCUMENTS

| | | | | |
|---|---|---|---|---|
| 2,862,382 | A | 12/1958 | Ames et al. | |
| 3,186,056 | A | 6/1965 | Hoveland | |
| 3,451,757 | A * | 6/1969 | Vaughan et al. | 401/139 |
| 4,090,914 | A | 5/1978 | Hauk et al. | |

(Continued)

FOREIGN PATENT DOCUMENTS

GB 2 346 406 A 8/2000

OTHER PUBLICATIONS

Tapetech Tool Company, Inc., Automatic Drywall Taping & Finishing Tools, Oct. 27, 2010, www.tapetech.com.

(Continued)

*Primary Examiner* — Mark A Osele

(74) *Attorney, Agent, or Firm* — Michael Best & Friedrich LLP

(57) ABSTRACT

The present disclosure describes a finisher system for finishing joints, seams or gaps in wallboard. According to an example embodiment, the finisher system comprises a finisher for dispensing mastic onto wallboard and an adapter configured for pivotally connecting the finisher to a handle. The finisher and adapter are cooperatively configured to substantially prevent sliding motion of the finisher relative to the adapter, and to ensure appropriate registration and orientation of the finisher relative to the adapter. A fluid communication path is defined within the adapter, allowing mastic to flow through the adapter. A pivot pin enables a first portion of the adapter to pivot relative to a second portion of the adapter, and defines a bore therein that permits mastic to flow through the pivot pin and between the adapter's first and second portions. The adapter is configured for attachment to a handle having a substantially tear drop shaped cross-section.

13 Claims, 4 Drawing Sheets

(56) References Cited

U.S. PATENT DOCUMENTS

| | | | | |
|---|---|---|---|---|
| 4,105,490 | A | 8/1978 | Lass | |
| 4,208,239 | A | 6/1980 | Lass | |
| 4,516,868 | A | 5/1985 | Molnar | |
| 4,907,955 | A | 3/1990 | Snipes | |
| 5,088,147 | A | 2/1992 | MacMillan | |
| 5,099,539 | A | 3/1992 | Forester | |
| 5,137,386 | A | 8/1992 | Mower | |
| 5,338,128 | A | 8/1994 | Blanco | |
| 5,368,461 | A | 11/1994 | Murphy | |
| 5,863,146 | A | 1/1999 | Denkins et al. | |
| 5,882,691 | A | 3/1999 | Conboy | |
| 5,895,316 | A | 4/1999 | Williams | |
| 5,902,451 | A | 5/1999 | O'Mara et al. | |
| 5,954,571 | A | 9/1999 | Case | |
| 6,253,454 | B1 | 7/2001 | Gietzen | |
| 6,325,708 | B1 | 12/2001 | Miles | |
| 6,450,232 | B1 | 9/2002 | Smythe, Jr. | |
| 6,450,723 | B1 | 9/2002 | Lithgow | |
| 6,484,782 | B1 | 11/2002 | Lewis et al. | |
| 6,565,252 | B2 | 5/2003 | Dillinger et al. | |
| 6,712,238 | B1 | 3/2004 | Mills | |
| 6,869,492 | B1 | 3/2005 | Kooistra | |
| 6,874,965 | B1 | 4/2005 | Mondloch et al. | |
| 7,114,869 | B2 | 10/2006 | MacMillan | |
| 7,674,059 | B2 | 3/2010 | Daigle | |
| 7,721,377 | B2 * | 5/2010 | Jungklaus et al. | 15/144.4 |
| 7,758,429 | B2 | 7/2010 | Crivelli et al. | |
| 7,806,613 | B2 | 10/2010 | Mondloch et al. | |
| 2001/0003563 | A1 * | 6/2001 | Schauer et al. | 401/5 |
| 2001/0053419 | A1 | 12/2001 | Ruha et al. | |
| 2005/0100386 | A1 | 5/2005 | Murray | |
| 2005/0193511 | A1 * | 9/2005 | St. James et al. | 15/144.4 |
| 2009/0255212 | A1 | 10/2009 | Henningson | |
| 2010/0014908 | A1 | 1/2010 | Campbell et al. | |
| 2010/0196078 | A1 | 8/2010 | Ovens | |

OTHER PUBLICATIONS

European Patent Office Examination Report, European Patent Application No. 11726562.9, mailed Nov. 22, 2013.

International Search Report and Written Opinion of the International Searching Authority, International Patent Application No. PCT/US2011/038821, mailed Sep. 5, 2011.

* cited by examiner

FINISHER SYSTEM

CROSS REFERENCE TO RELATED APPLICATION

This application claims the benefit of U.S. Provisional Application No. 61/350,372, filed Jun. 1, 2010.

FIELD OF THE INVENTION

The present invention relates, generally, to the field of tools for finishing gaps, seams, or joints between construction materials.

BACKGROUND

Today, many construction materials come in the form of substantially planar panels or rolls which are unrollable into, essentially, planar panels. The construction materials are, in both cases, secured with appropriate fasteners and/or adhesives to the framing members, sheathing and/or decking of building walls, floors, ceilings and roofs. Such construction materials comprise, without limitation: (a) drywall, gypsum board, plasterboard, cement board, greenboard, blueboard, wood, and foam board for use in forming interior, and in some cases exterior, building walls and/or ceilings; (b) felt paper, underlayments, membranes, wraps, and other similar materials that are generally applied to sheathing and/or decking to protect underlying building materials from the effects of weather, to reduce the amount of air and/or moisture infiltration through a building's structure, and/or to provide insulation against heat and sound transmission; and (c) other similar construction materials. The term "wallboard" is used herein to mean and refer, collectively, to such construction materials.

When individual panels or unrolled rolls of such wallboard are positioned side-by-side in/on a building structure as is often the case, the panels or unrolled rolls define gaps, seams or joints therebetween and are joined together with tape, sealant, filler and/or adhesive substances to form a monolithic structure. The tape may be manufactured from paper, fiberglass, or other material, be woven or non-woven, and be or not be backed with an adhesive substance. The tape is, generally, applied over the gaps, seams or joints either by hand or through use of a taping tool. The sealant, filler and/or adhesive substances may include, but not be limited to, drywall compound, glue, caulk, resin, epoxy, and other similar substances that are collectively referred to herein by the term "mastic". The tape and mastic may be used alone or in combination to seal, fill and/or hide the gaps, seams or joints and secure the individual panels or unrolled rolls together. When the tape and mastic are used in combination to hide a joint between pieces of wallboard, the mastic aids in securing the tape to the wallboard while being featherable away from the joint to cause the joint and tape to blend in and provide a smooth, substantially level surface with the wallboard to either side of the joint.

To apply, screed, smooth and/or feather the mastic relative to a gap, seam, joint, and/or tape, an appropriate finishing tool is selected and used based, at least, on the particular wallboard product, tape, and/or mastic being employed, and the location and orientation of the gap, seam or joint. In situations where the wallboard on both sides of a gap, seam or joint therebetween substantially defines a single plane, a finishing tool known as a "finisher" is often used to quickly apply a thin, uniform layer of mastic over tape covering the gap, seam or joint. The finisher generally comprises a partial enclosure defining a variable geometry cavity therein for holding the mastic to be applied over the tape. The partial enclosure may be supplied with mastic on a continual basis via a connected pump or may be manually loaded with mastic on an as needed basis by a user. The partial enclosure has a hingedly mounted pressure plate that is biased by one or more biasing members relative to the remainder of the partial enclosure so as to continually attempt to return the pressure plate to a retracted position and stop the flow of mastic from the partial enclosure via an opening therein. The pressure plate connects to a handle used by a user to hold the finisher in contact with wallboard and over tape covering a joint. By exerting a desired amount of pressure to the pressure plate via the handle and moving the finisher longitudinally over the joint, a user may partially overcome the forces exerted by the biasing members and apply a correspondingly desired amount of mastic over the tape and joint while feathering the mastic laterally away from the joint.

In a finisher system of at least one manufacturer, the back of the finisher's pressure plate has an opposed pair of fasteners and captive wing nuts secured thereto and the handle has an adapter affixed to an end thereof such that the adapter (and, hence, the handle) is attached to the back of the pressure plate via the fasteners and wing nuts. More specifically, the adapter has a connector plate defining a pair of opposed slots that are appropriately sized and spaced apart to respectively receive the fasteners and wing nuts. To attach the adapter to the back of the finisher's pressure plate, the adapter's connector plate is first placed adjacent to and in contact with the back of the finisher's pressure plate. The connector plate is then slid relative to and against the back of the pressure plate until each of the slots receives a fastener. The wing nuts are then tightened against the connector plate to hold the connector plate and pressure plate together.

Unfortunately, if a wing nut is not tightened sufficiently, the corresponding fastener may slide partially or entirely out of its respective connector plate slot during use of the finisher, thereby allowing the connector plate to slide at least partially free from the pressure plate at a possibly inopportune time and creating potentially disastrous consequences. To avoid such an undesired event, many users commonly use a hammer to strike the wing nuts and insure that the wing nuts are sufficiently tight to hold the connector plate and pressure plate together. Striking the wing nuts with a hammer tends to damage the wing nuts and could, ultimately, render the finisher's pressure plate unsecurable to the adapter's connector plate.

Therefore, there is a need in the industry for a finisher system that securely attaches to a handle therefor with ease, and that may address other problems, difficulties, and/or shortcomings of current technology that may or may not be described herein.

SUMMARY

Briefly described, the present invention comprises a finisher system, including systems, apparatuses and methods, for finishing joints, seams or gaps between pieces of wallboard. According to an example embodiment and without limitation, the finisher system comprises a finisher for dispensing mastic onto wallboard and an adapter configured for pivotally connecting the finisher to a handle. The finisher and adapter are cooperatively configured to substantially prevent sliding motion of the finisher relative to the adapter, and to ensure appropriate registration and orientation of the finisher relative to the adapter. A fluid communication path is defined within the adapter, allowing mastic to flow through the adapter. A pivot pin enables a first portion of the adapter to pivot relative to a second portion of the adapter, and defines a bore therein that permits mastic to flow through the pivot pin and between the first and second portions of the adapter.

Advantageously, the cooperative configuration of the finisher and adapter of the finisher system virtually eliminates sliding between the finisher and adapter as is problematic with certain prior art finishers and adapters. Such cooperative configuration also enables rapid assembly and disassembly of the finisher and adapter to allow cleaning and/or stowage, while substantially ensuring proper registration between the finisher and adapter. Additionally, because the adapter of the example embodiment is configured for attachment to and interaction with a handle having a substantially tear drop shaped cross-section, the finishing system aids users in opposing torque tending to cause rotation of the finisher away from and out of contact with wallboard during use.

Other advantages and benefits of the present invention will become apparent upon reading and understanding the present specification when taken in conjunction with the appended drawings.

DETAILED DESCRIPTION

Figure 1:
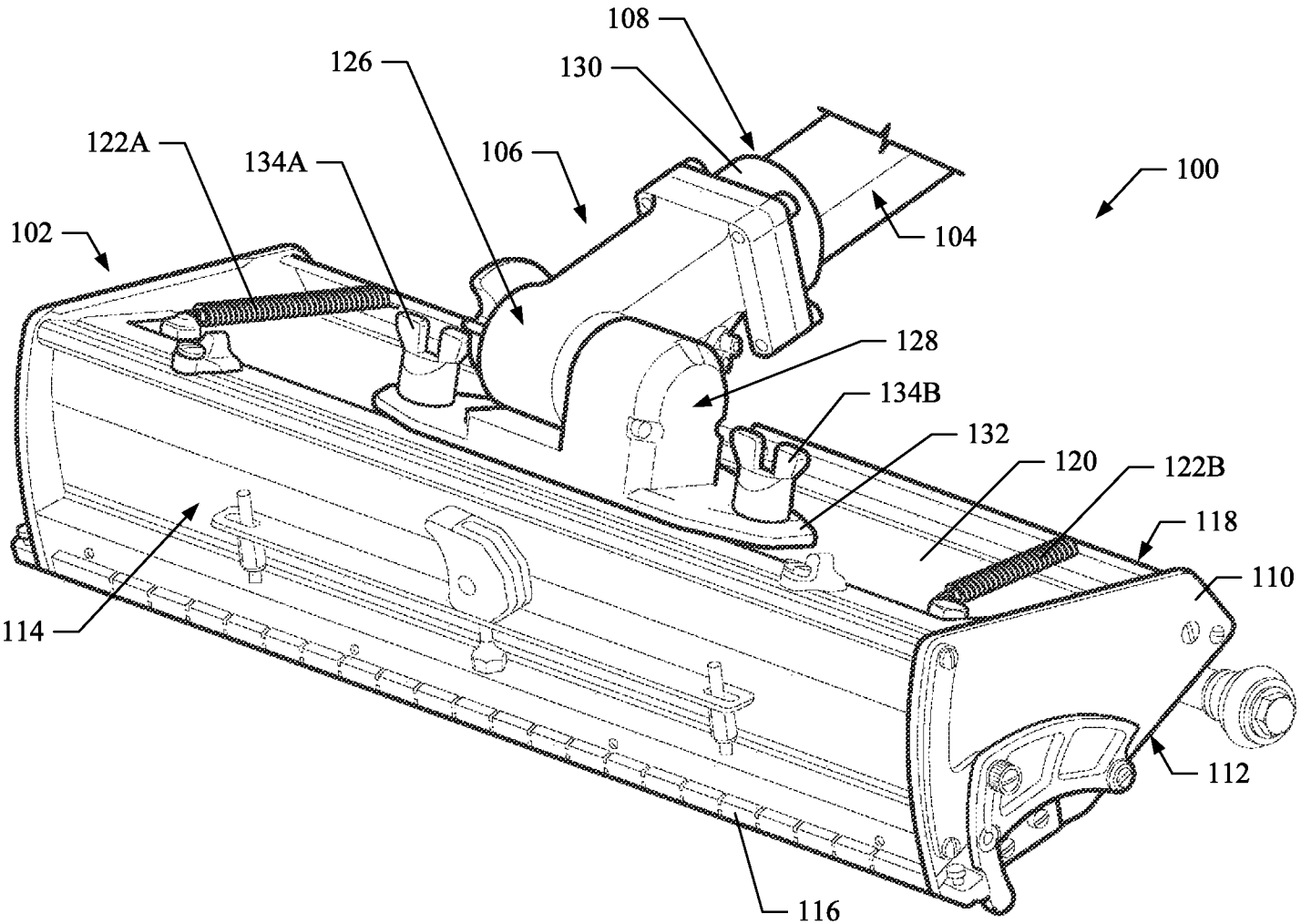
FIG. 1 displays a front perspective view of a finisher system in accordance with an example embodiment of the present invention.

Referring now to the drawings in which like numerals represent like elements or steps throughout the several views, FIG. 1 displays a front perspective view of a finisher system 100 in accordance with an example embodiment of the present invention. The finisher system 100 comprises a finisher 102, a handle 104, and an adapter 106 securedly affixed to an end 108 of the handle 104. The finisher system 100 enables a user thereof to apply a desired layer of mastic over tape covering a joint between pieces of wallboard with confidence that the finisher 102 will not become uncoupled from or slip relative the attached handle 104 at an undesirable time during use. The finisher system 100 also ensures that the finisher 102 is registered and oriented properly relative to the adapter 106, and is not oriented at an incorrect angle relative to the adapter 106. By ensuring such correct orientation, the finisher system 100 improves the likelihood that mastic will be feathered properly in a lateral direction away from the joint. Additionally, the finisher system 100 permits the finisher 102 and adapter 106 to be readily detached from the system's handle 104 when desired for cleaning or stowage of the system's components.

The finisher 102 comprises a partial enclosure 110 for holding mastic to be dispensed and applied over a taped joint between pieces of wallboard. The partial enclosure 110 has a base wall 112 that is placed by a user in contact with the wallboard and over the taped joint. The partial enclosure 110 also has a front wall 114 with a blade holder 116 depending therefrom that holds a blade (not visible) for screeding and feathering dispensed mastic. A slot in the base wall 112 rearward of the blade holder 116 permits mastic to be pushed out of the partial enclosure 110 and over the tape while being smoothed out by pulling of the base wall 112 over the tape. The partial enclosure 110 includes a rear wall 118 and a pressure plate 120 that is hingedly mounted to the rear wall 118. Together with the various walls of the partial enclosure 110, the pressure plate 120 defines a variable geometry, internal cavity (not visible) within the finisher 102 that holds the mastic. Movement of the pressure plate 120 relative to the base wall 112 and the remainder of the partial enclosure 110 causes the geometry and volume of the internal cavity to change.

A pair of biasing members 122A, 122B are attached to the partial enclosure's rear wall 118 and to the pressure plate 120 near the forward wall 114. The biasing members 122A, 122B exert forces on the pressure plate 120 tending to bias the pressure plate 120 into a first position relative to base wall 112 and the remainder of the partial enclosure 110. When the pressure plate 120 is in the first position, the internal cavity of the partial enclosure 110 has maximum volume enabling the partial enclosure 110 to be loaded, or reloaded, with mastic. Also, if mastic is supplied to the partial enclosure 110 via a pump, a certain amount of mastic will be delivered to the partial enclosure 110 after the pump has been turned off and by virtue of the biasing members 122A, 122B pulling the pressure plate 120 toward the first position, such mastic may be received by the partial enclosure 110 without oozing of such mastic out of the finisher's slot. By applying a desired amount of force to the pressure plate 120 via the handle 104 attached to the pressure plate 120 by adapter 106, a user may partially overcome the forces created by the biasing members 122A, 122B, thereby exerting pressure on the mastic present in the partial enclosure's internal cavity and causing the mastic to exit the partial enclosure's slot. According to the example embodiment, the biasing members 122A, 122B comprise extension springs, but it should be appreciated that other forms of biasing members may be used in other example embodiments.

The finisher system's pressure plate 120 has a pair of fasteners 124A, 124B (see FIG. 4) that protrude from the back of the pressure plate 120. In accordance with the example embodiment, the fasteners 124A, 124B are threaded for receipt by corresponding fasteners 134A, 134B of the finisher system's adapter 106. The fasteners 124A, 124B are threaded through threaded inserts (not visible) in the pressure plate 120 so that the fasteners 124A, 124B are securely mounted thereto. The finisher system's adapter 106 is releasably secured to and between the system's finisher 102 and handle 104.

The adapter 106 comprises, according to the example embodiment, a coupling portion 126 and a connector portion 128 pivotally connected to the coupling portion 126. The coupling portion 126 couples to the finisher system's handle 104 and has a longitudinal axis substantially collinear with a longitudinal axis of the handle 104. More specifically, the coupling portion 126 has a collar 130 that is secured to and receives therein an end portion of the handle 104. The collar 130 defines an internal bore therein that is cooperatively shaped and sized relative to the periphery of the handle 104 such that the collar 130 extends substantially around and in snug contact with the periphery of the handle 104. In accordance with the example embodiment, the handle 104 and the bore of the collar 130 have a generally tear drop cross-sectional shape. The handle 104 and bore of the collar 130 may, in other embodiments, have other cooperative cross-sectional shapes.

The connector portion 128 of the adapter 106 releasably connects to the finisher 102 and is rotatable relative to the adapter's coupling portion 126 about a transverse axis extending through parts of the coupling and connector portions 126, 128. Pivoting of the connector portion 128 relative to the coupling portion 126 enables the finisher 102 to pivot relative to the handle 104, thereby enabling a user to manipulate the handle 104 relative to the finisher 102 as needed during use to maintain the finisher 102 in appropriate contact with wallboard while moving the finisher 102 over a taped joint. Pivoting of the connector portion 128 relative to the coupling portion 126 also aids a user in applying appropriate force to the finisher's pressure plate 120 as the finisher 102 is moved over a taped joint.

The connector portion 128 of the finisher system's adapter 106 has a connector plate 132 and a pair of threaded fasteners 134A, 134B secured to the connector plate 132 such that each fastener 134A, 134B is positioned so as to receive a respective cooperatively threaded fastener 124A, 124B therein when the finisher 102 is attached to the finisher system's adapter 104. According to the example embodiment, each fastener 134A, 134B comprises a captive wing nut secured to the connector plate 132 to avoid the loss thereof during use of the finisher system 100. In other embodiments, the fasteners 134A, 134B may not be captive or, alternatively, comprise other forms of fasteners.

Figure 2:
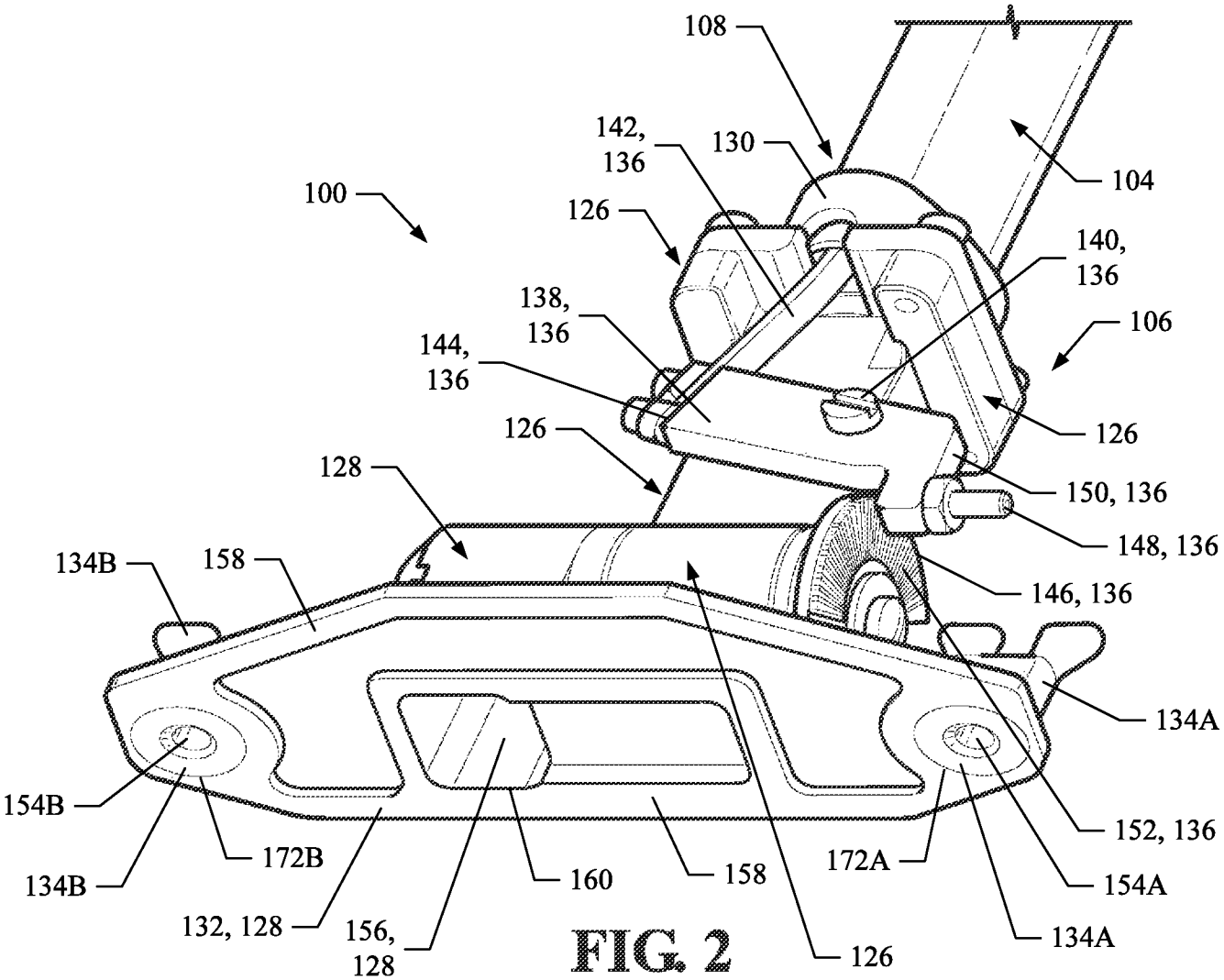
FIG. 2 displays a bottom perspective view of an adapter of the finisher system of FIG. 1 in accordance with the example embodiment of the present invention.

FIG. 2 displays a bottom perspective view of the adapter 106 of the finisher system 100 in accordance with the example embodiment of the present invention. As seen in FIG. 2, the adapter 106 comprises a brake assembly 136 for controlling pivoting of (and, if desired by a user, to stop pivoting of) the connector portion 128 relative to the coupling portion 126 and, hence, pivoting of the finisher 102 relative to the handle 104. The brake assembly 136 includes a brake arm 138 secured to the adapter's coupling portion 126 by a fastener 140 of the brake assembly 136 that allows the brake arm 138 to rotate about a longitudinal axis of the fastener 140. A brake linkage 142 exits the end of the handle 104 proximate collar 130 and is affixed to a first end 144 of the brake arm 138.

The brake assembly 136 further comprises a brake disk 146 mounted so as to pivot in unison with the connector portion 128 relative to the adapter's coupling portion 126. A fastener 148 is located at a second end 150 of the brake arm 138 and positioned to contact or engage the brake disk 146. According to the example embodiment, the fastener 148 comprises a set screw, but may comprise other forms in other embodiments. The brake disk 146 has a plurality of radially-extending ridges 152 that are contacted or engaged by the fastener 148 to restrict or limit movement rotation of the brake disk 146 in response to a force exerted on the first end 144 of the brake arm 138 by the brake linkage 142 tending to rotate the brake arm's first end 144 generally toward the collar 130. Such rotation brings the fastener 148 into contact or engagement with the radially-extending ridges 152 of the brake disk 146, thereby limiting or preventing rotation of the brake disk 146 and, hence, rotation of the attached finisher 102 relative to the handle 104. It should be appreciated that in other embodiments, the brake disk 146 may have a plurality of dimples, a plurality of holes or slots corresponding to different orientations of a finisher relative to the handle 104, an abrasive finish, or take on another form in lieu of the radially-extending ridges 152 in order to limit or restrict movement of the finisher 102 when desired by a user.

As described above with reference to FIG. 1 and as illustrated again in FIG. 2, the adapter's connector portion 128 comprises a connector plate 132 having first and second fasteners 134A, 134B captive thereto. Each fastener 134A, 134B defines a respective bore 154A, 154B for receiving a respective threaded fastener 124A, 124B extending from the pressure plate 120 of the system's finisher 102. According to the example embodiment, the threaded fasteners 124A, 124B have a substantially circular cross-section, and the bores 154A, 154B have a substantially circular cross-section and are sized to snugly receive respective threaded fasteners 124A, 124B in threaded engagement therewith. The fasteners 134A, 134B and fasteners 124A, 124B are positioned so as to allow cooperative mating between the connector plate 132 and the finisher 102. Once the fasteners 124A, 124B are received within the respective bores 154A, 154B and the fasteners 134A, 134B are tightened, the system's finisher 102 is appropriately registered relative to the connector plate 132 with very little relative movement or slippage being possible between the connector plate 132 and attached finisher 102.

The adapter's connector portion 128 defines a channel 156 therein for conveying mastic. The connector plate 132 has a first surface 158 that resides in contact with the finisher 102 when attached thereto. The first surface 158 defines an opening 160 therein that is in fluid communication with the channel 156. The finisher 102 has a hole 174 therein (see FIG. 4) that is cooperatively located to align with opening 160 of the connector plate 132. During use, mastic flows through channel 156, out of the connector portion 128 via opening 160, and into the finisher 102 via the cooperatively located hole 174 in the pressure plate 120 of the finisher 102.

Figure 3:
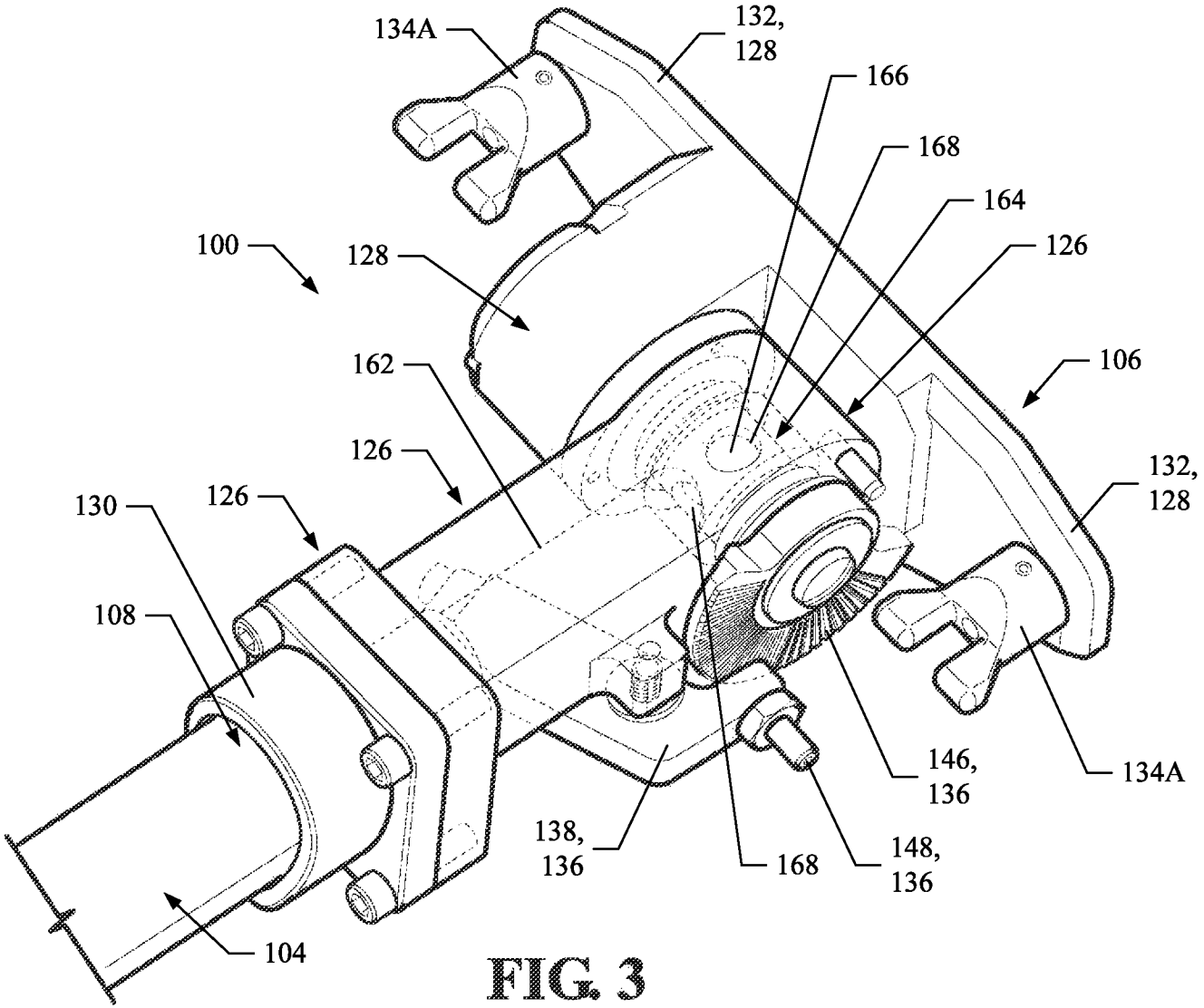
FIG. 3 displays a side perspective, hidden line view of the adapter of the finisher system of FIG. 1 in accordance with the example embodiment of the present invention, showing internal features of the adapter.

FIG. 3 displays a side perspective, hidden line view of the adapter 106 of the finisher system 100 in accordance with the example embodiment of the present invention. As seen in FIG. 3, the adapter's coupling portion 126 defines a bore 162 therein that is in fluid communication with a channel in the handle 104 at an end 108 thereof. The bore 162 is configured to receive mastic from the channel in the handle (which receives mastic from a pump in fluid communication with the handle's channel) and to convey the mastic toward the finisher 102. The adapter's connector portion 128 further comprises a pivot pin 164 attached to the connector plate 132 and to brake disk 146 such that connector plate 132, pivot pin 164, and brake disk 146 rotate together relative to the adapter's coupling portion 126. The pivot pin 164 defines a bore 166 therein that is in fluid communication with channel 156 of the connector portion 128 and with the coupling portion's bore 162 via a plurality of holes 168 defined by pivot pin 164. During use, mastic flows from the coupling portion's bore 162, through holes 168 and bore 166, and into the connector portion's channel 156 for subsequent delivery to the finisher 102 via the connector plate's opening 160.

Figure 4:
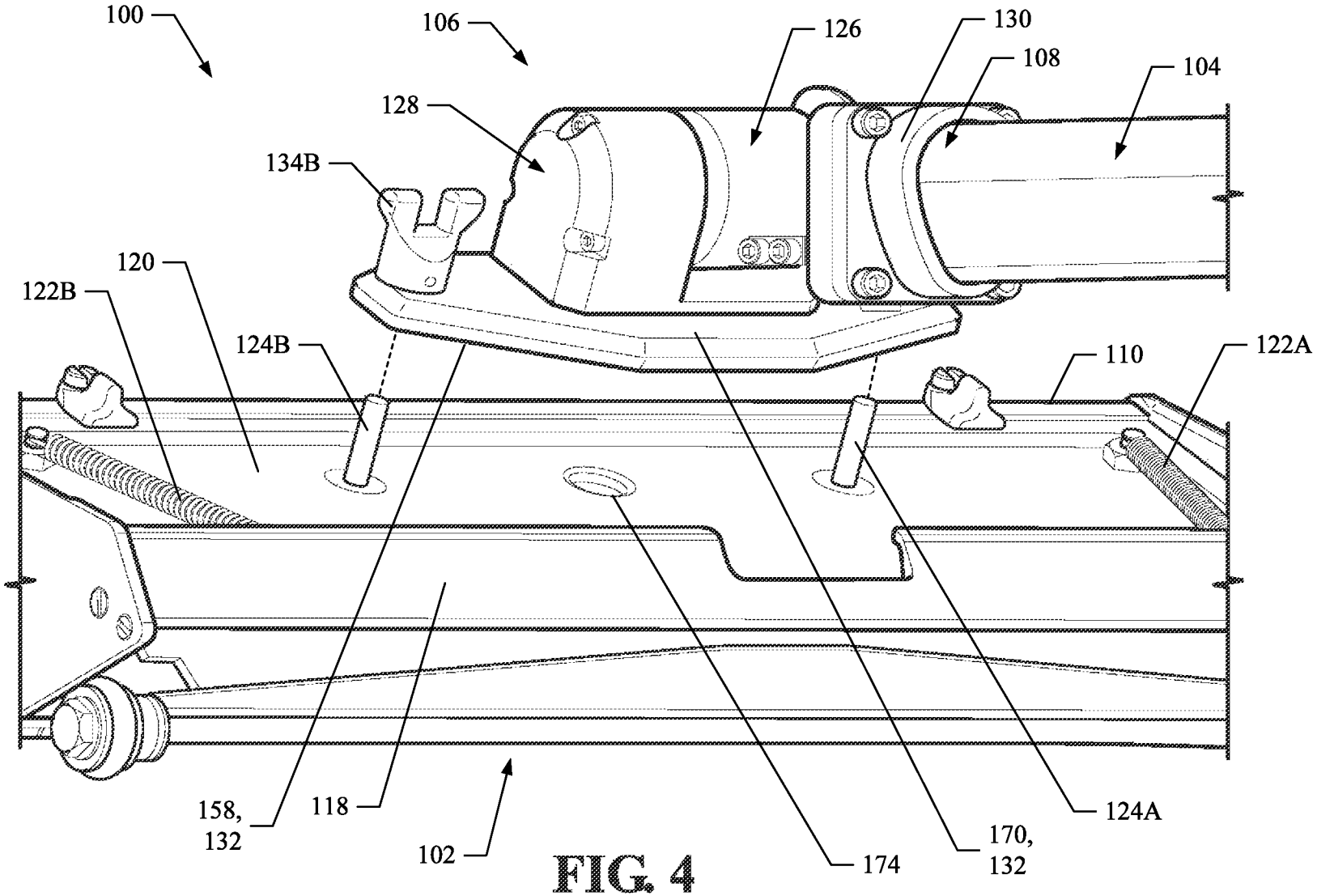
FIG. 4 displays a partial, exploded, rear perspective view of the finisher system of FIG. 1 in accordance with the example embodiment of the present invention.

FIG. 4 displays a partial, exploded, rear perspective view of the finisher system 100 in accordance with the example embodiment of the present invention. As seen in FIG. 4, the first surface 158 of the adapter's connector plate 132 is substantially planar and the connector plate 132 has a second substantially planar surface 170 opposed to the first surface 158. Fasteners 134A, 134B are fixedly attached to second surface 170 in alignment with bores 172A, 172B extending through the connector plate 132 (see FIG. 2) and are readily accessible for turning by a user during assembly of the connector plate 132 to pressure plate 120 and disassembly of the connector plate 132 from pressure plate 120.

To assemble the finisher system's adapter 106 to the system's finisher 102, the adapter's connector plate 132 is positioned with fasteners 124A, 124B received by bores 154A, 154B of fasteners 134A, 134B. Fasteners 134A, 134B are then rotated relative to the fasteners 124A, 124B to engage respective fasteners 124A, 124B and, upon further similar rotation, to bring the first surface 158 of the adapter's connector plate 132 into contact with the pressure plate 120. When the system's adapter 106 is fully connected to the finisher 102, the first surface 158 of the connector plate 132 resides adjacent to and in contact with the pressure plate 120 with fasteners 124A, 124B, respectively, protruding through bores 154A, 154B and engaged by fully tightened fasteners 134A, 134B. According to the example embodiment and in the assembled position, hole 174 defined by the pressure plate 120 is aligned with opening 160 of the adapter's connector portion 128 to allow mastic to flow from the system's handle 104 and adapter 106 into the partial enclosure 110 of the finisher 102.

To dissemble the finisher system's adapter 106 from the system's finisher 102, fasteners 134A, 134B are rotated relative to fasteners 124A, 124B in the opposite angular direction used during assembly, to disengage the fasteners 124A, 124B and fasteners 134A, 134B. Once the fasteners 124A, 124B are disengaged, the finisher 102 and adapter 106 are pulled apart removing the fasteners 124A, 124B from corresponding bores 154A, 154B and taking connector plate 132 out of contact with pressure plate 120.

Because the fasteners 124A, 124B reside within appropriately sized bores 154A, 154B of fasteners 134A, 134B (and can only reside within bores 154A, 154B in a single, proper orientation) when the finisher 102 is coupled to the adapter 106, the finisher 102 is correctly registered relative to the adapter 106. Also by virtue of the fasteners 124A, 124B residing within bores 154A, 154B when the finisher 102 is coupled to the adapter 106, slight loosening of the fasteners 134A, 134B as may occur during use will not cause the finisher 102 to become separated from the handle 104 and adapter 106.

It should be appreciated that while the adapter 106 of the example embodiment has been described herein as providing a continuous flow of mastic to an attached finisher, the adapter 106 may be used with attached corner finishing tools and other finishing tools that are designed to receive a continuous flow of mastic, and may be used with attached finishers, corner finishing tools, or other finishing tools that are not designed to receive a continuous flow of mastic. It should be also appreciated that while the adapter 106 of the example embodiment has been described herein as being configured to apply a braking force to limit or restrict the movement of an attached finisher or other finishing tool requiring limitation or restriction of movement relative to a handle 104, the adapter 106 may be used with corner finishing tools or other finishing tools that do not require limitation or restriction of movement relative to a handle 104. Additionally, it should be appreciated that in other example embodiments in which the adapter 106 need not deliver a continuous flow of mastic to an attached finisher or other finishing tool, the adapters 106 of such example embodiments may not define an internal bore 162 or channel 156 for the flow of mastic therethrough. In addition, it should be appreciated that while the finisher system 100 of the example embodiment has been described herein with respect to finishing wallboard, the finisher system 100 may be employed in connection with finishing other building materials and with other tools for finishing other building materials.

Whereas the present invention is described in detail with respect to the example embodiment, it should be understood that variations and modifications may be effected within the spirit and scope of the present invention, as described herein before and as defined in the appended claims.

What is claimed is:

1. A finisher system for finishing wallboard, said finisher system comprising:

a finisher for dispensing mastic onto wallboard, said finisher having a pressure plate including a pair of fasteners extending therefrom, said pressure plate defining a hole therethrough for receiving a flow of mastic; and an adapter having a first portion securable to a handle and a second portion releasably connected to said finisher, said first portion defining a bore therein for receiving and communicating a flow of mastic from the handle, said second portion defining a channel therein for receiving and communicating a flow of mastic from said first portion and having a plate defining an opening therethrough in fluid communication with said channel, said plate defining a pair of bores for respectively receiving said pair of fasteners of said finisher;

wherein the receipt of said pair of fasteners respectively within said pair of bores aligns said hole of said pressure plate with said opening of said plate solely in a single, pre-determined, registered orientation for communicating a flow of mastic from said second portion of said adapter to said finisher; and wherein said second portion of said adapter has an elongate pin having a bore therein for receiving and communicating a flow of mastic between said first portion and said second portion, said elongate pin rotatably connecting said first portion of said adapter for relative rotation between said first portion and said second portion solely about a linear axis transverse to a longitudinal axis of the handle.

2. The finisher system of claim 1, wherein each bore of said pair of bores of said adapter has a substantially circular cross-sectional shape.

3. The finisher system of claim 1, wherein the receipt of said pair of fasteners respectively within said pair of bores substantially eliminates sliding of said finisher relative to said adapter.

4. A finisher system for finishing wallboard, said finisher system comprising:

a finisher for dispensing mastic onto wallboard; and an adapter connected to said finisher and connectable to a handle having a channel therein for delivering mastic to said adapter, said adapter comprising a pivot pin enabling pivoting of said finisher relative to the handle only about a longitudinal axis of said pivot pin substantially perpendicular to a longitudinal axis of the handle, said adapter defining a first opening for receiving mastic from the channel of the handle and a second opening for delivering mastic to said finisher, and said adapter further defining a fluid communication path between said first opening and said second opening allowing the flow of mastic between said first opening and said second opening.

5. The finisher system of claim 4, wherein said pivot pin defines a bore therein forming a portion of the fluid communication path between said first opening and said second opening.

6. The finisher system of claim 4, wherein said adapter comprises a coupling portion having a substantially tear drop cross-sectional shape for connection to the handle.

7. The finisher system of claim 4, wherein said finisher system further comprises a brake assembly for controlling pivoting of said finisher relative to the handle.

8. The finisher system of claim 7, wherein said adapter comprises a connector portion connected to said finisher, and said brake assembly includes a brake disk that pivots in unison with said pivot pin and said connector portion.

9. An adapter of a finisher system for finishing wallboard, said adapter comprising:

a first portion for connection to a handle; and a second portion for releasable connection to a finisher, said second portion and said first portion being coupled and configured for relative rotation therebetween about an elongate pivot pin, said second portion being further configured to substantially prevent sliding of said second portion relative to the finisher, wherein said first portion, said second portion, and said elongate pivot pin define a fluid communication path extending therethrough for receiving mastic from the handle and delivering mastic to the finisher.

10. The adapter of claim 9, wherein said second portion comprises a plurality of bores oriented cooperatively with and for receiving a respective plurality of fasteners of the finisher therein.

11. The adapter of claim 10, wherein said second portion further comprises a plurality of captive fasteners, and said plurality of captive fasteners define said plurality of bores therein.

12. The adapter of claim 9, wherein the handle has a tear drop shaped cross-section, and said first portion is cooperatively configured for attachment to and interaction with the handle.

13. The adapter of claim 9, wherein said adapter further comprises a brake mechanism for controlling relative rotation between said first portion and said second portion.

* * * * *